US008322343B2

(12) United States Patent
Cardin

(10) Patent No.: US 8,322,343 B2
(45) Date of Patent: Dec. 4, 2012

(54) LOWER EXTREMITY EXERCISER AND POSITIONING DEVICE

(76) Inventor: Grace Cardin, Lisbon, CT (US)

( * ) Notice: Subject to any disclaimer, the term of this patent is extended or adjusted under 35 U.S.C. 154(b) by 297 days.

(21) Appl. No.: 12/820,123

(22) Filed: Jun. 21, 2010

(65) Prior Publication Data

US 2010/0319707 A1 Dec. 23, 2010

Related U.S. Application Data

(60) Provisional application No. 61/218,610, filed on Jun. 19, 2009.

(51) Int. Cl.
*A61G 15/00* (2006.01)
*A47C 17/86* (2006.01)

(52) U.S. Cl. ..... 128/845; 5/648

(58) Field of Classification Search ..... 128/846, 128/869, 882, 845, 892, 889; 602/12, 41, 602/60, 61, 62, 65, 1, 5, 23, 24, 25, 26, 28, 602/27, 29; 297/68–76, 271.1, 279, 287, 297/423.1, 423.19, 423.26, 423.3, 423.34, 297/423.36; 5/648–651

See application file for complete search history.

(56) References Cited

U.S. PATENT DOCUMENTS

| | | | | | |
|---|---|---|---|---|---|
| 3,946,451 | A * | 3/1976 | Spann | 5/650 |
| 5,125,123 | A * | 6/1992 | Engle | 5/648 |
| 5,476,105 | A * | 12/1995 | Toth | 5/648 |
| 5,871,457 | A * | 2/1999 | Swedberg et al. | 602/24 |
| 6,298,508 | B1 * | 10/2001 | McCloskey | 5/632 |
| 7,017,215 | B1 * | 3/2006 | Singer et al. | 5/646 |
| 7,305,728 | B2 * | 12/2007 | Schlieps | 5/657 |

* cited by examiner

*Primary Examiner* — Patricia Bianco
*Assistant Examiner* — Tarla Patel
(74) *Attorney, Agent, or Firm* — Mark Young, P.A.

(57) ABSTRACT

A lower extremity exerciser and positioning device includes a generally wedge-shaped inferior and a generally wedge-shaped superior support. Each support has a top surface and curved trailing edge. A limb-cradling furrow extends across the top surfaces and trailing edges. The inferior support may be used alone, or with the superior support stacked on top. Spacers may be added to extend and elevate the device. Releasable attachments are provided to secure together adjacent components. The device may be configured to accommodate various patient physiques; used to relieve heel, sacral and buttock pressure for purposes of avoiding pressure ulcers; and used to allow patients to independently perform various knee and hip exercises.

20 Claims, 13 Drawing Sheets

LOWER EXTREMITY EXERCISER AND POSITIONING DEVICE

RELATED APPLICATION

This application is a non-provisional of and claims the benefit of priority of U.S. provisional application 61/218,610, having a filing date of Jun. 19, 2009, the entire contents of which are incorporated herein by this reference and made a part hereof.

FIELD OF THE INVENTION

This invention relates to a supportive cushion assembly, and more particularly, to a support assembly that positions for relief of some types of low back pain, for lower extremity edema control, and for active hip extensor strengthening, active knee extensor strengthening, passive knee extensor range-of-motion, active sacral pressure relief, and passive heel pressure relief.

BACKGROUND

Healthcare and hospital costs are impacted negatively by problems related to post-operative pain and weakness, weakness due to prolonged bed rest, lower extremity edema due to infection and/or inactivity, and pressure ulcers at the buttocks and heels due to prolonged bed rest and associated lower extremity weakness. These problems result in longer hospital and skilled nursing facility stays as patients undergo rehabilitative physical therapy, and wound care treatments.

Currently, physical therapists and nurses are actively involved with getting patients out of bed post-operatively, positioning to prevent pressure ulcers, and providing exercises to strengthen weak muscles. The reality of the healthcare system, however, is that often there are shortages of healthcare professionals to provide adequate treatment for all patients, and often those who are most at risk are not receiving adequate care and rehabilitation due to healthcare shortages, time-constraints, and medicare and other third party payer limitations. Furthermore there is a lack of adequate equipment for providing exercise and positioning at the hospital or skilled nursing facility bedside. Pillows and make-shift blanket rolls are currently used in hospitals across the nation. Makeshift devices are time consuming to construct and have to be constructed individually for each patient, due to cross contamination and infection control procedures. Pillows are inadequate as they compress easily and often slip and slide out of place. Current commercially available products address one or two of these patient problems but are generally not constructed for multiple-patient use and do not provide the height and versatility to address individual problems with positioning and exercise. For example, many leg wedges provide comfortable positioning for bilateral lower legs, but do not address positioning needs for a patient with lower leg edema in a lower leg cast, who would need the casted leg to be elevated higher than the non-involved leg. Also the design and density of the components of the proposed positioning device will address the exercise needs of the patient with an amputation, who will need to use the smaller upper wedge for lower extremity hip extensor strengthening, an extremely important exercise in preparation for a lower limb prosthesis.

Lower extremity exercise is an area which is often neglected, in hospitals across the nation. Often, in acute care settings physical therapists and nurses have only enough time to get non-ambulatory patients out of bed and toileted, before moving on to the next patient. In skilled nursing facilities, patients are often treated in group settings, where non specific exercise is provided, if at all. In addition to time constraints and lack of equipment, specific lower extremity exercise and adequate positioning are not provided for patients in the acute hospital setting as well as in skilled nursing facility settings, due to low medicare reimbursement rates and associated decreased staffing. All of these factors contribute to a "revolving door" situation as elderly patients become weaker and are less functional, with more incidences of falls. They then become less active due to a fear of falling, sometimes actually falling and breaking a hip, and move back and forth between hospital and nursing home settings. This results in patients who are very debilitated and who are not functional and may go on to develop flexion contractures and pressure ulcers. In addition there are specific patient populations such as those with morbid obesity, who often develop lower extremity weakness and lack the means to improve their function.

What is needed is a lower extremity positioning and exercise device that can be used effectively in the home, hospital, skilled nursing facility, or clinic setting, to provide comfortable and effective positioning for lower extremity hip and knee extensor strengthening, as well as edema control, sacral and heel pressure relief, and relief of some types of low back pain. The device should be sized to accommodate variability in leg length and width, and may be used independently or under the recommendation and supervision of a healthcare professional, i.e. physician, nurse, or physical therapist. In an institutional setting the device should have continuous sealed surfaces which could be cleaned with an anti-bacterial solution, and used between patients. Alternatively the device could be manufactured without this type of coating or cover, for single patient use, and could include Velcro connectors, and adjustable foam lengths and widths. The device should be lightweight, easy to position, and easy to use.

The invention is directed to overcoming one or more of the problems and solving one or more of the needs as set forth above.

SUMMARY OF THE INVENTION

To solve one or more of the problems set forth above, in an exemplary implementation of the invention, a lower extremity exerciser and positioning device includes a generally wedge-shaped inferior support and a generally wedge-shaped removable superior support. Each support has a top surface and curved trailing edge. A limb-cradling furrow extends across the top surfaces and trailing edges. The inferior support may be used alone, or with the superior support stacked on top. Spacers may be added to extend and elevate the device. Releasable attachments are provided to secure together adjacent components. The device may be configured to accommodate various patient physiques; used to relieve heel, sacral and buttock pressure for purposes of avoiding pressure ulcers; and used to allow patients to independently perform various knee and hip exercises.

In one exemplary embodiment, a lower extremity exerciser and positioning device includes a pair of wedge-shaped foam-core therapeutic supports configurable in a stacked arrangement, the pair of wedge-shaped foam-core therapeutic supports, including an inferior support and a removable superior support. The inferior support has a planar inferior bottom surface, parallel planar inferior sides that are perpendicular to the inferior bottom surface, a planar inferior leading edge that is perpendicular to the inferior bottom surface and to the planar sides, a planar inferior trailing edge that is perpendicular to the inferior bottom surface and to the inferior sides, a sloped inferior planar top surface, and a curved inferior transitional surface coupling the sloped inferior planar top surface to the planar inferior trailing edge. The sloped inferior planar top surface extends from the planar inferior leading edge to the curved inferior transitional surface. A gradient of the sloped inferior planar top surface is positive from the planar inferior leading edge to the curved inferior transitional surface.

The superior support has a planar superior top surface, parallel planar superior sides that are perpendicular to the planar superior top surface, a planar superior leading edge that is perpendicular to the planar superior top surface and to the planar sides, a convex curved superior trailing edge, a sloped superior planar bottom surface, and a concave curved superior transitional surface coupling the sloped superior planar bottom surface to the curved superior trailing edge. The sloped superior planar bottom surface extends from the planar superior leading edge to the curved superior transitional surface. A gradient of the sloped superior planar bottom surface is positive from the planar inferior leading edge to the curved inferior transitional surface.

The superior support is stackable on the inferior support. The bottom surface of the superior support is configured to mate with the top surface of the inferior support. The top surface of the superior support provides a surface for supporting a limb.

In another embodiment, an exemplary lower extremity exerciser and positioning device according principles of the invention may further include at least one height adjusting spacer releasably attachable to the planar inferior bottom surface.

In another embodiment, an exemplary lower extremity exerciser and positioning device according principles of the invention may further include at least one length adjusting spacer releasably attachable to the planar inferior leading edge.

In another embodiment, an exemplary lower extremity exerciser and positioning device according principles of the invention may further include at least one length adjusting spacer releasably attachable to the planar inferior leading edge, and at least one height adjusting spacer releasably attachable to the planar inferior bottom surface.

In another embodiment, an exemplary lower extremity exerciser and positioning device according principles of the invention may further include at least one length adjusting spacer releasably attachable to the planar superior leading edge.

In another embodiment, an exemplary lower extremity exerciser and positioning device according principles of the invention may further include at least one inferior length adjusting spacer releasably attachable to the planar inferior leading edge, and at least one superior length adjusting spacer releasably attachable to the planar superior leading edge. The at least one superior length adjusting spacer is stackable on the at least one inferior length adjusting spacer.

In another embodiment, an exemplary lower extremity exerciser and positioning device according principles of the invention may further include at least one height adjusting spacer releasably attachable to the planar inferior bottom surface, at least one inferior length adjusting spacer releasably attachable to the planar inferior leading edge, and at least one superior length adjusting spacer releasably attachable to the planar superior leading edge. The at least one superior length adjusting spacer is stackable on the at least one inferior length adjusting spacer.

In another embodiment, an exemplary lower extremity exerciser and positioning device according principles of the invention may further include at least one inferior length adjusting spacer releasably attachable to the planar inferior leading edge. Each length adjusting inferior spacer has a sloped top inferior spacer surface with a gradient that is substantially the same as the gradient of the sloped inferior planar top surface.

In another embodiment, an exemplary lower extremity exerciser and positioning device according principles of the invention may further include at least one superior length adjusting spacer releasably attachable to the planar superior leading edge. Each length adjusting superior spacer has a sloped bottom superior spacer surface with a gradient that is substantially the same as the gradient of the sloped superior planar bottom surface.

In another embodiment, an exemplary lower extremity exerciser and positioning device according principles of the invention may further include an inferior concave furrow that extends across the sloped inferior planar top surface, the curved inferior transitional surface and the planar inferior trailing edge. The furrow provides an elongated, shallow, concave, depression for cradling an engaged portion of a limb.

In another embodiment, an exemplary lower extremity exerciser and positioning device according principles of the invention may further include a superior concave furrow that extends across the superior planar top surface and the convex curved superior trailing edge. The furrow provides an elongated, shallow, concave, depression for cradling an engaged portion of a limb.

In another embodiment, an exemplary lower extremity exerciser and positioning device according principles of the invention may further include an inferior concave furrow that extends across the sloped inferior planar top surface, the curved inferior transitional surface and the planar inferior trailing edge. The furrow provides an elongated, shallow, concave, depression for cradling an engaged portion of a limb. Likewise, a superior concave furrow extends across the superior planar top surface and the convex curved superior trailing edge. Again, the furrow provides an elongated, shallow, concave, depression for cradling an engaged portion of a limb.

In another embodiment, an exemplary lower extremity exerciser and positioning device according principles of the invention may further include an inferior concave furrow that extends across the sloped inferior planar top surface, the curved inferior transitional surface and the planar inferior trailing edge. The furrow provides an elongated, shallow, concave, depression for cradling an engaged portion of a limb. A superior concave furrow extends across the superior planar top surface and the convex curved superior trailing edge. The furrow provides an elongated, shallow, concave, depression for cradling an engaged portion of a limb. The inferior concave furrow is aligned with the superior concave furrow when the superior support is stacked on the inferior support.

In another embodiment, an exemplary lower extremity exerciser and positioning device according principles of the invention has an inferior concave furrow with a radius of curvature between about 2 and 5 inches. The inferior concave furrow extends across the sloped inferior planar top surface, the curved inferior transitional surface and the planar inferior trailing edge. The inferior concave furrow provides an elongated, shallow, concave, depression for cradling an engaged portion of a limb. The superior concave furrow has a radius of curvature between about 2 and 5 inches. The superior concave furrow extends across the superior planar top surface and the convex curved superior trailing edge. The superior concave furrow provides an elongated, shallow, concave, depression for cradling an engaged portion of a limb. The inferior concave furrow is aligned with the superior concave furrow when the superior support is stacked on the inferior support.

In another embodiment, an exemplary lower extremity exerciser and positioning device according principles of the invention has a gradient of the sloped inferior planar top surface between 15° and 60°, and a gradient of the sloped superior planar bottom surface between 15° and 60°.

In another embodiment, an exemplary lower extremity exerciser and positioning device according principles of the invention may further include an inferior concave furrow with a radius of curvature between about 2 and 5 inches. The inferior concave furrow extends across the sloped inferior planar top surface, the curved inferior transitional surface and the planar inferior trailing edge. The inferior concave furrow provides an elongated, shallow, concave, depression for cradling an engaged portion of a limb. A superior concave furrow also has a radius of curvature between about 2 and 5 inches. The superior concave furrow extends across the superior planar top surface and the convex curved superior trailing edge. The superior concave furrow provides an elongated, shallow, concave, depression for cradling an engaged portion of a limb. The inferior concave furrow is aligned with the superior concave furrow when the superior support is stacked on the inferior support. At least one inferior length adjusting spacer is releasably attachable to the planar inferior leading edge. Each length adjusting inferior spacer has a sloped top inferior spacer surface with a gradient that is substantially the same as the gradient of the sloped inferior planar top surface and a concave furrow in the sloped top inferior spacer surface. The concave furrow in the sloped top inferior spacer surface is aligned with the inferior concave furrow when the inferior length adjusting spacer is releasably attached to the planar inferior leading edge. At least one superior length adjusting spacer is releasably attachable to the planar superior leading edge. Each length adjusting superior spacer has a sloped bottom superior spacer surface with a gradient that is substantially the same as the gradient of the sloped superior planar bottom surface.

In another embodiment, an exemplary lower extremity exerciser and positioning device according principles of the invention may further include an inferior concave furrow with a radius of curvature between about 2 and 5 inches. The inferior concave furrow extends across the sloped inferior planar top surface, the curved inferior transitional surface and the planar inferior trailing edge. The inferior concave furrow provides an elongated, shallow, concave, depression for cradling an engaged portion of a limb. A superior concave furrow has a radius of curvature between about 2 and 5 inches. The superior concave furrow extends across the superior planar top surface and the convex curved superior trailing edge. The superior concave furrow provides an elongated, shallow, concave, depression for cradling an engaged portion of a limb. The inferior concave furrow is aligned with the superior concave furrow when the superior support is stacked on the inferior support. At least one inferior length adjusting spacer is releasably attachable to the planar inferior leading edge. Each length adjusting inferior spacer has a sloped top inferior spacer surface with a gradient that is substantially the same as the gradient of the sloped inferior planar top surface and a concave furrow in the sloped top inferior spacer surface. The concave furrow in the sloped top inferior spacer surface is aligned with the inferior concave furrow when the inferior length adjusting spacer is releasably attached to the planar inferior leading edge. At least one superior length adjusting spacer is releasably attachable to the planar superior leading edge. Each length adjusting superior spacer has a sloped bottom superior spacer surface with a gradient that is substantially the same as the gradient of the sloped superior planar bottom surface, and a top superior spacer surface with a concave furrow. The concave furrow in the top superior spacer surface is aligned with the superior concave furrow when the superior length adjusting spacer is releasably attached to the planar superior leading edge.

In another embodiment, an exemplary lower extremity exerciser and positioning device according principles of the invention may further include an inferior concave furrow with a radius of curvature between about 2 and 5 inches. The inferior concave furrow extends across the sloped inferior planar top surface, the curved inferior transitional surface and the planar inferior trailing edge. The inferior concave furrow provides an elongated, shallow, concave, depression for cradling an engaged portion of a limb. A superior concave furrow has a radius of curvature between about 2 and 5 inches. The superior concave furrow extends across the superior planar top surface and the convex curved superior trailing edge. The superior concave furrow provides an elongated, shallow, concave, depression for cradling an engaged portion of a limb. The inferior concave furrow is aligned with the superior concave furrow when the superior support is stacked on the inferior support. At least one inferior length adjusting spacer is releasably attachable to the planar inferior leading edge. Each length adjusting inferior spacer has a sloped top inferior spacer surface with a gradient that is substantially the same as the gradient of the sloped inferior planar top surface and a concave furrow in the sloped top inferior spacer surface. The concave furrow in the sloped top inferior spacer surface is aligned with the inferior concave furrow when the inferior length adjusting spacer is releasably attached to the planar inferior leading edge. At least one superior length adjusting spacer is releasably attachable to the planar superior leading edge. Each length adjusting superior spacer has a sloped bottom superior spacer surface with a gradient that is substantially the same as the gradient of the sloped superior planar bottom surface, and a top superior spacer surface with a concave furrow. The concave furrow in the top superior spacer surface is aligned with the superior concave furrow when the superior length adjusting spacer is releasably attached to the planar superior leading edge. A plurality of hook and loop fasteners are provided and configured for attaching the inferior support to the removable superior support, and the at least one superior length adjusting spacer to the planar superior leading edge, and the at least one inferior length adjusting spacer to the planar inferior leading edge.

BRIEF DESCRIPTION OF THE DRAWINGS

The foregoing and other aspects, objects, features and advantages of the invention will become better understood with reference to the following description, appended claims, and accompanying drawings, where:

Figure 1:
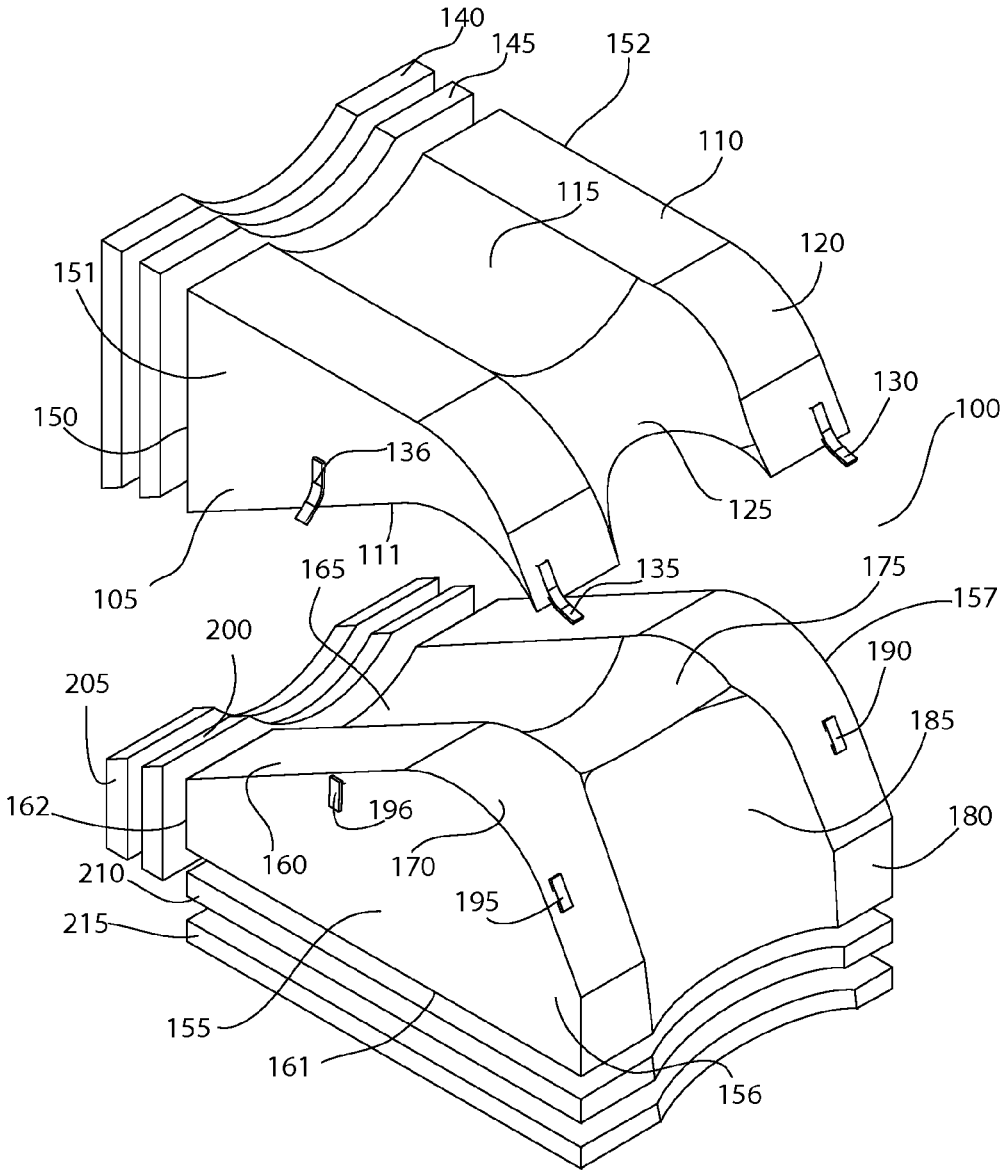
FIG. 1 is a first top perspective exploded view of an exemplary lower extremity exerciser and positioning device according to principles of the invention.
Figure 2:
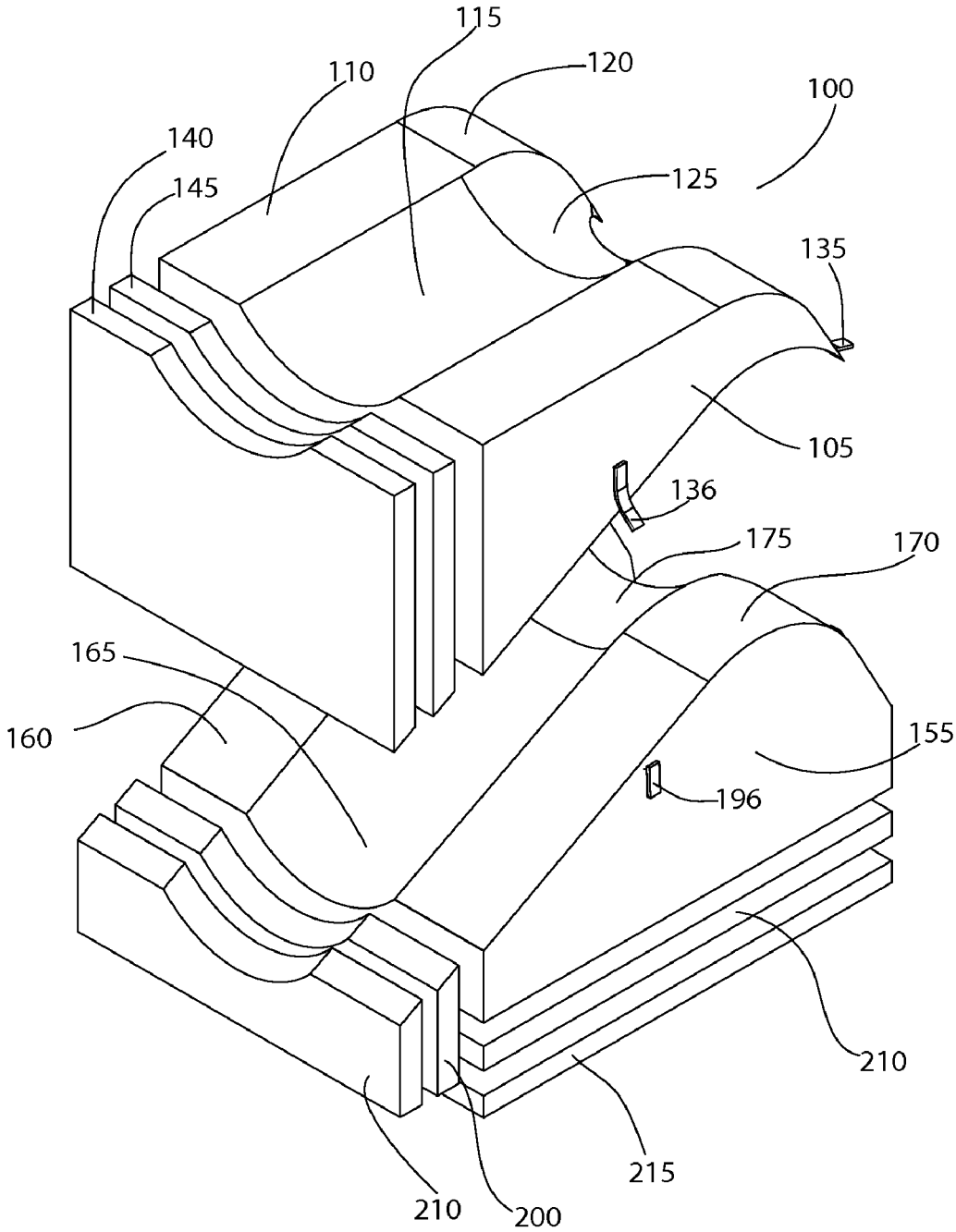
FIG. 2 is a second top perspective exploded view of an exemplary lower extremity exerciser and positioning device according to principles of the invention.

Those skilled in the art will appreciate that the figures are not intended to be drawn to any particular scale; nor are the figures intended to illustrate every embodiment of the invention or every exercise or position attainable using the invention. The invention is not limited to the exemplary embodiments depicted in the figures or the types of components, configurations, shapes, relative sizes, ornamental aspects or proportions shown in the figures.

DETAILED DESCRIPTION

Referring to the Figures, in which like parts are indicated with the same reference numerals, various views of an exemplary lower extremity exerciser and positioning device 100 according to principles of the invention are conceptually illustrated. The lower extremity exerciser and positioning device 100 comprises a pair of generally wedge-shaped therapeutic supports 105, 155 that are configurable in a stacked arrangement. The wedge-shaped therapeutic supports 105, 155 include an inferior support 155 (i.e., a lower or bottom support) and a removable superior support 105 configured to mate with the top surface 160 of the inferior support 155. This mating arrangement ensures proper positioning and resists sliding disengagement during use.

A lower extremity exerciser and positioning device according to principles of the invention may be used treat afflictions and conditions. By way of example and not limitation, indications for use of a device according to principles of the invention include Pressure ulcers, patients at high risk for skin breakdown on Braden scale, de-conditioning, lower extremity weakness, cerebral vascular accidents, post surgical hip/knee repairs, morbid obesity, bed rest due to hypo-tension or hypertension, lower extremity edema control and low back discomfort. Use of such device provides many benefits, including, but not limited to, strengthening hip and knee extensors, improving gait and transfers, improving edema control, and providing pressure relief.

The inferior support 155 features a substantially planar bottom surface 161; parallel planar sides 156, 157 that are perpendicular to the bottom surface 161; a planar leading edge 162 that is perpendicular to the bottom surface 161 and to the sides 156, 157; a planar trailing edge 180 that is perpendicular to the bottom surface 161 and to the sides 156, 157; a sloped planar top surface 160, and a curved transitional surface 170 coupling the sloped planar top surface 160 to the planar trailing edge 180. The top surface comprised of the sloped planar top surface 160 and curved transitional surface 170 serve two purposes. First, when the superior support 105 is stacked on the inferior support 155, the top surface of the inferior support 155 mates with the bottom surface of the superior support. Second, when the inferior support 155 is used without the superior support 105, the top surface of the inferior support 155 provides a surface for supporting a limb.

The superior support 105 features a concave bottom surface 111; parallel planar sides 151, 152 that are perpendicular to the bottom surface 111; a planar leading edge 150 that is perpendicular to the sides 151, 152; a horizontal planar top surface 110, and a curved trailing 120. When the superior support 105 is stacked on the inferior support 155, the bottom surface of the superior support 105 mates with the top surface of the inferior support 155, and the top surface of the superior support 105 provides a surface for supporting a limb.

A plurality of optional spacers may be provided to adjust the height and length of the therapeutic supports 105, 155. Height adjusting spacers 210, 215 are provided for releasable attachment to the bottom 161 of the inferior support 155. Length adjusting spacers 140, 145 and 200, 205 are provided for the superior 105 and inferior 155 therapeutic supports. The length adjusting spacers 140, 145 for the superior support 105 releasably attach to the planar first end 150 opposite the curved end 120. The length adjusting spacers 200, 205 for the inferior support 155 releasably attach to the planar first end 162 opposite the curved end 170. The length adjusting spacers are angularly configured to extend the wedge shape of each of the therapeutic supports 105, 155. Thus, the top surface of each length adjusting spacer 200, 205 for the inferior support 155 has the same slope as the top surface 160 of the inferior support 155. Likewise, the bottom surface of each length adjusting spacer 140, 145 for the superior support 105 has the same slope as the bottom surface 111 of the superior support 105. Concomitantly, the bottom surface of each length adjusting spacer 200, 205 for the inferior support 155 is configured to be planar and level with either the bottom surface 161 of the inferior support 155 or the bottom surface of the height adjusting spacer 215. Similarly, the top surface of each length adjusting spacer 140, 145 for the superior support 105 is configured to be planar and level with the top surface 110 of the superior support 105. When the spacers 140, 145 and 200, 205 are attached, they have the effect of extending the wedge shapes, including the furrows.

Each therapeutic support 105, 155 includes a concave furrow that extends across its top and curved surfaces. The furrow provides an elongated, shallow, concave, narrow depression for cradling a limb (e.g., a leg), or portion thereof. Illustratively, a furrow 115 extends from the planar leading edge 150, across the top surface 110 of the superior support 105. The furrow 115 continues with a curved furrow section 125 that extends across the curved trailing edge. This curved furrow section 125 merges with a similarly curved furrow section 185 in the curved transitional surface 170 of the inferior support 155. The furrow of the of the inferior support 155 includes a straight furrow section 165 extending from the planar leading edge 162, across the sloped surface 160 to the curved transition 170. Another furrow section 185 extends from the curved transition 170 across the trailing edge 180 of the inferior support 155. A curved transitional furrow section 175 couples the straight furrow section 165 to the trailing edge furrow section 185.

Figure 3:
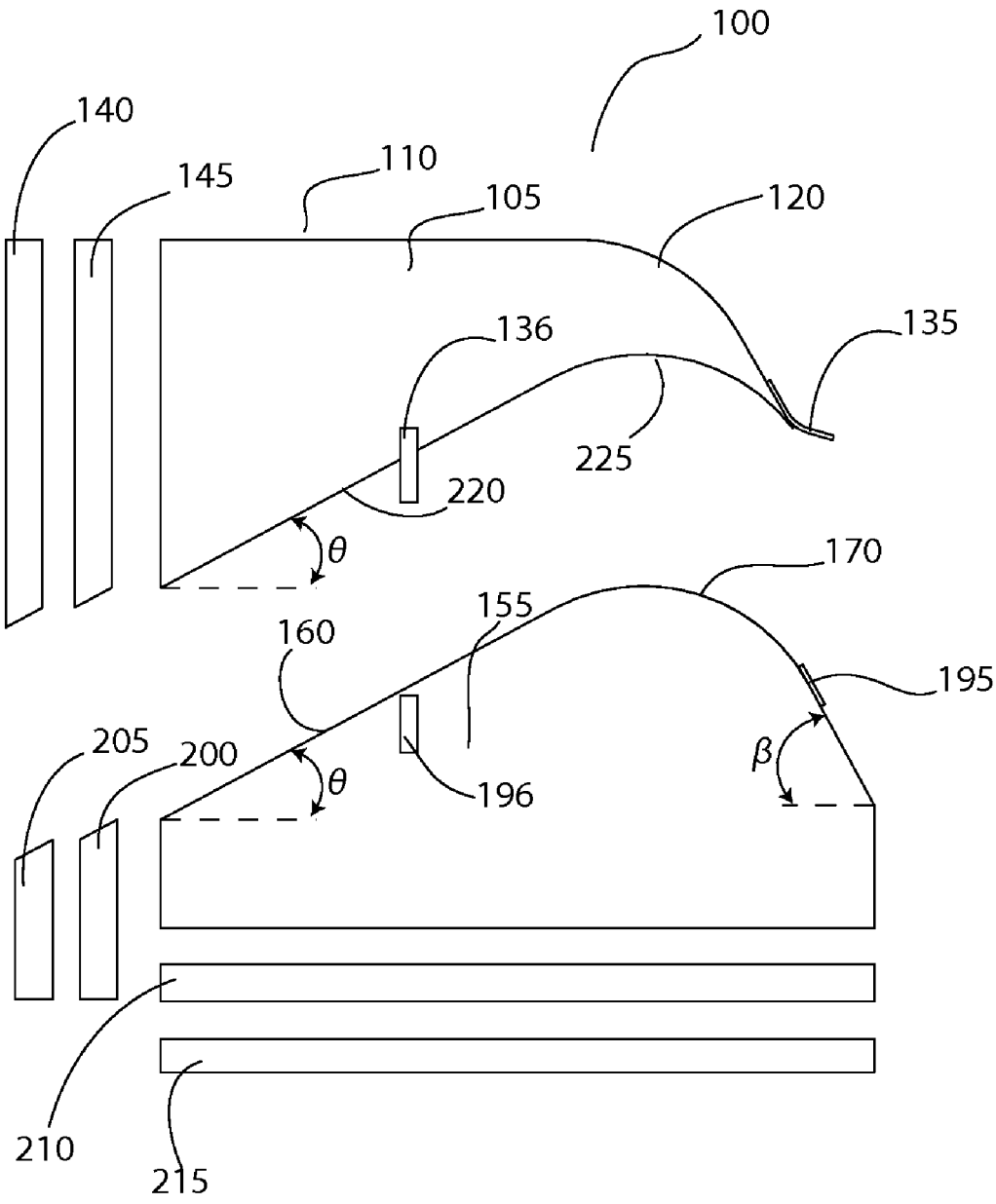
FIG. 3 is a side exploded view of an exemplary lower extremity exerciser and positioning device according to principles of the invention.
Figure 4:
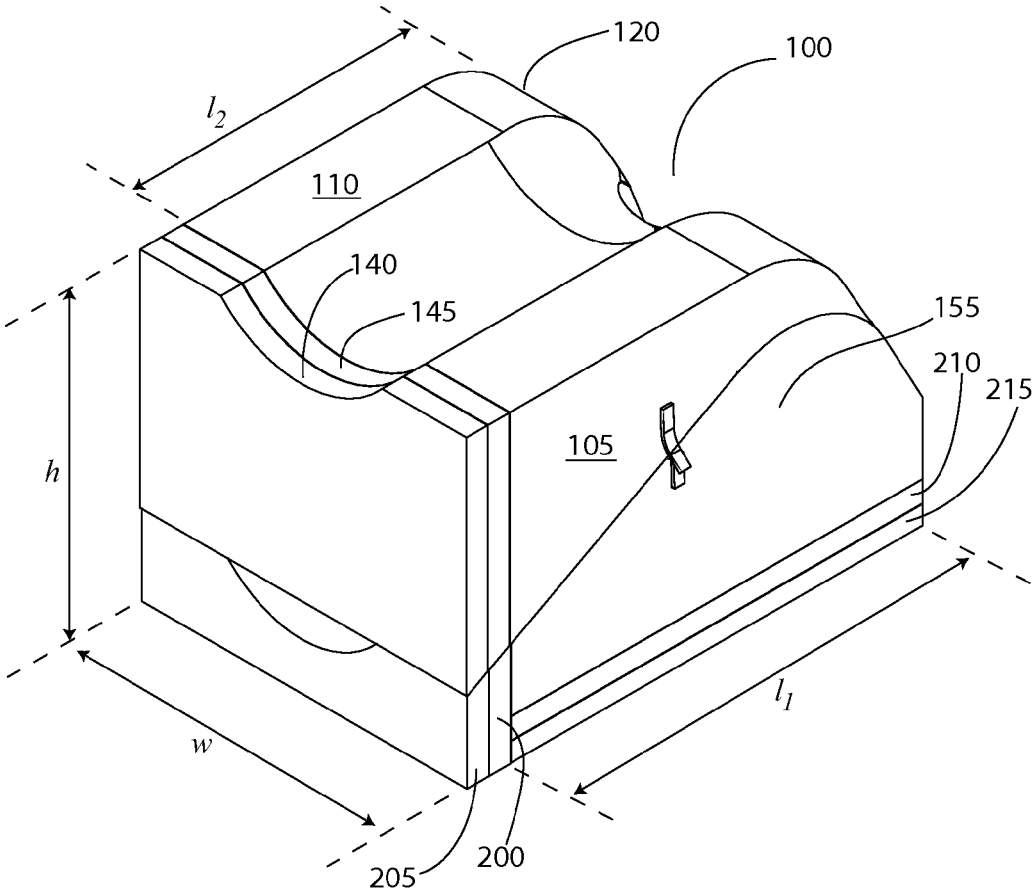
FIG. 4 is a first top perspective view of an assembled exemplary lower extremity exerciser and positioning device according to principles of the invention.

The angles of the various sloped surfaces of the supports and the radii of curvatures of various features are configured to facilitate use by a patient. The angle θ (FIG. 3) of the sloped surface 160 relative to the horizon may be between 15° and 60°, preferably about 30°. The bottom surface of the superior support features a similar angle. The angle β of the trailing edge of the inferior support may be between 30° and 90°, preferably about 45° to 60°.

The radius of curvature of each furrow should be sufficient to cradle a limb, such as a leg. The radius of curvature may be a constant for the entire furrow, or may vary over the length of the furrow. By way of example and not limitation, the radius may decrease from a large radius for cradling a person's thigh to a smaller radius for cradling a calf. The radius of curvature may vary depending upon the person for whom the support is designed (e.g., adult, youth or child). However, a radius of curvature between about 2 and 5 inches is preferred, with a radius between 2.5 and 4 inches being particularly preferred to accommodate most patients.

A corresponding furrow is also provided in spacers. For example, furrows are provided in the top surface of each length adjusting spacer 140, 145, 200, and 205. Likewise, furrows are provided in the trailing edge of each elevating spacer. The spacer furrows provide extension and continuity of the furrow in the extended support.

The wedge-shaped therapeutic supports 105, 155 are capable of various modes of use. As discussed below, the inferior support 155 may be used alone, without the removable superior support 105. Alternatively, the inferior support 155 may be in combination with the removable superior support 105, with the removable superior support 105 stacked on the inferior support 155.

Releasable attachment elements are provided to releasably attach each removable component. By way of example and not limitation, hook and loop fastener flaps 130, 135, 136 and corresponding tabs 190, 195, 196 may be provided on the superior and inferior supports 105, 155. Similar hook and loop fastening elements may be provided to join adjacent spacers and to join spacers to corresponding surface of the superior and inferior supports. The hook and loop fasteners provide easy-to-use reliable releasable attachments. Those skilled in the art will appreciate that releasable attachments other than hook and loop fasteners may be utilized in lieu of and/or in addition to hook and loop fasteners, and such releasable attachments come within the scope of the invention. Non-limiting examples include snaps, buttons, studs, magnetic attachments and any other releasable attachment means that allow repeated removal and attachment.

Figure 5:
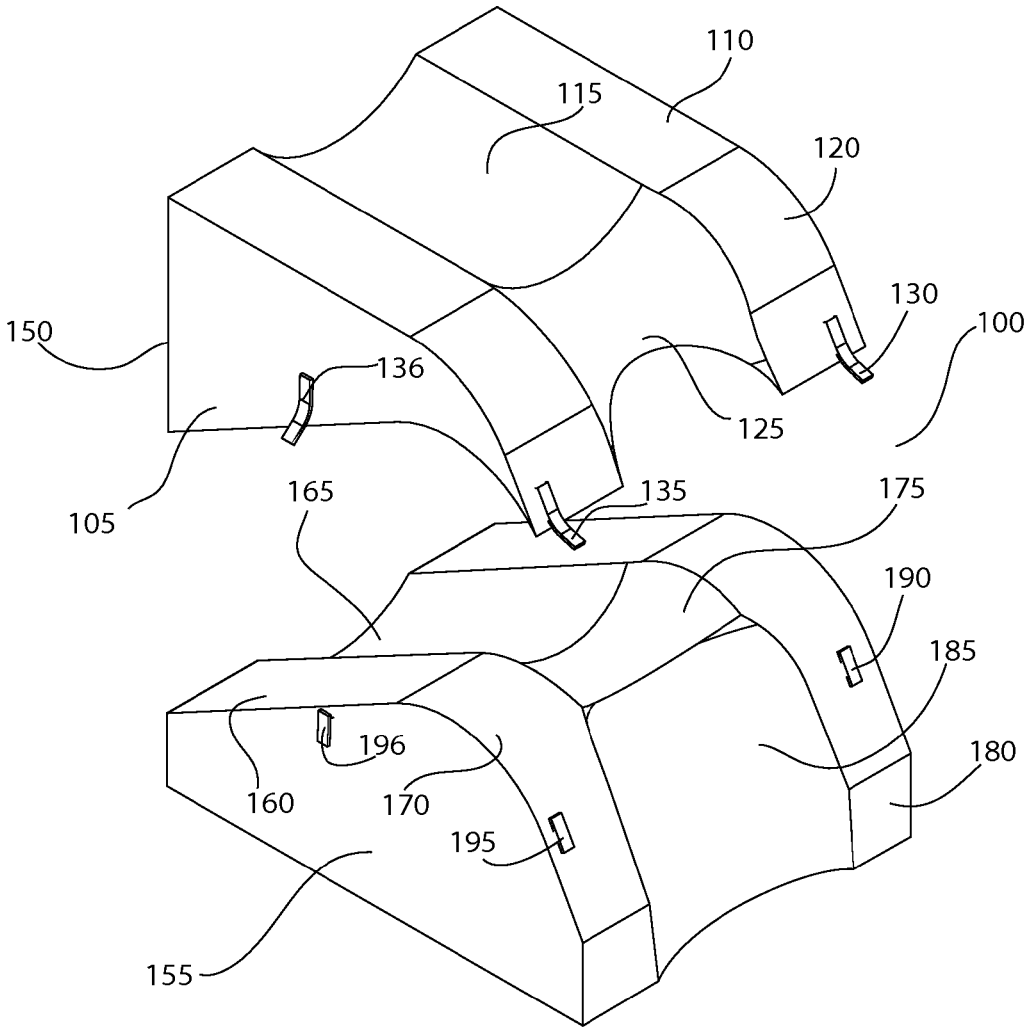
FIG. 5 is a top perspective exploded view of an exemplary lower extremity exerciser and positioning device, without optional spacers, according to principles of the invention.
Figure 6:
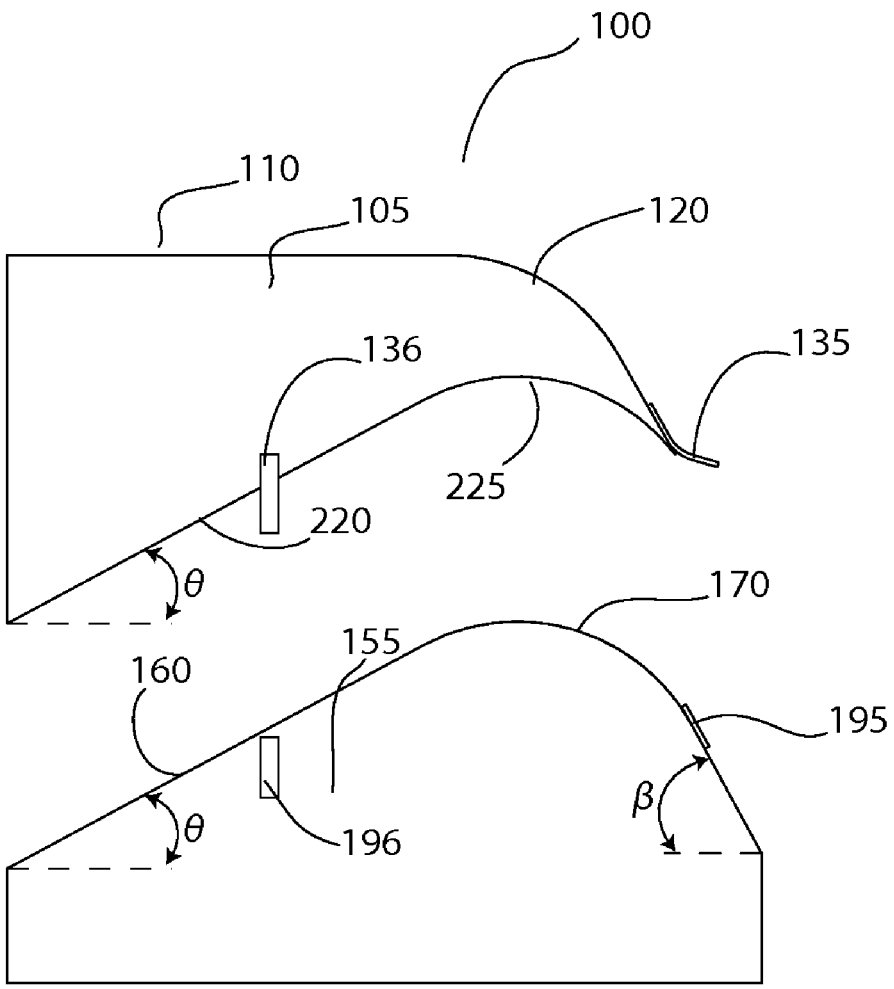
FIG. 6 is a side exploded view of an exemplary lower extremity exerciser and positioning device, without optional spacers, according to principles of the invention.
Figure 7:
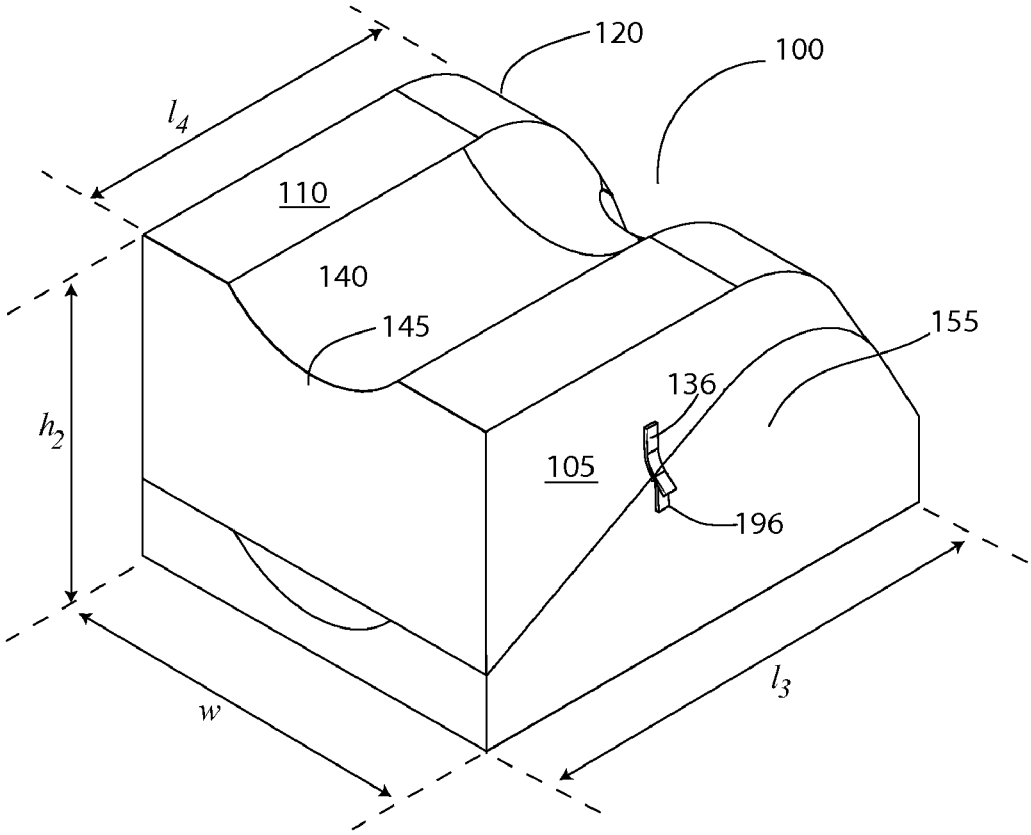
FIG. 7 is a top perspective view of an assembled exemplary lower extremity exerciser and positioning device, without optional spacers, according to principles of the invention.

As mentioned above, spacers are optional. Embodiments without spacers are conceptually illustrated in FIGS. 5 through 7. In those embodiments, the superior and inferior supports are the same as those described above.

The invention is not limited to embodiments that include the combination of the inferior support 155 and superior support. Rather, the inferior support 155 may be sold and/or used alone, or with the superior support 105.

The lower extremity exerciser and positioning device is designed to be used in hospital beds, at home and or in the clinic. The device is primarily for lower extremity strengthening and assistance in the prevention of buttock, sacral and heel pressure ulcers. In addition the device can be used to assist in controlling lower extremity edema.

The lower extremity exerciser and positioning device may be manufactured from materials found suitable for the manufacture of therapeutic and orthopedic cushions. Such materials include urethane foam, latex foam, natural fibers, and synthetic fibers. Both the latex foam and the urethane foam may further include open-celled foam, closed-celled foam, or microcellular foam. The material should retain its shape and provide adequate firmness to support the weight of a person's leg and downward force exerted during exercise. However, the material should also provide adequate comfort to the user and, therefore, the device should not be so firm as to be hard to the touch. The device may include an integral skin or a cover that conforms to the shape of the device. The cover may be manufactured from materials found suitable for the manufacture of covers of therapeutic and orthopedic cushions. The cover material may include cotton, polyester, a cotton/polyester blend, denim, leather, suede, natural fur, and synthetic fur. The cover may be sewn in place to conform to the shape of the device. The cover may removable to facilitate cleaning of the cover, or changing the cover to change the appearance of the device. A removable cover may include means for fastening, such as a zipper, buttons, fasteners, and hook and loop fasteners. To resist the growth of mold, bacteria, and the accumulation of allergens, the device can be made anti-bacterial, non-allergenic, hypoallergenic, and mold resistant materials. Additionally, the material may be fire retardant. A washable, flexible cover (e.g., vinyl) that is impervious to water may be removably attached or permanently formed on (e.g., by coating, shrink wrapping or over molding) the device.

In another embodiment, the lower extremity exerciser and positioning device may be manufactured as an inflatable comprising one or more air chambers, which are hollow enclosures bound by a soft and flexible airtight material (such as vinyl). A gas (e.g., air) can enter into or leave from through valves (e.g., one valve per air chamber). Seams may be overlapped and reinforced with seam tape, both inside and out. An orifice or conduit may connect air chambers, thereby allowing one valve to serve a plurality of chambers. The deflated device can be rolled up or folded and carried or stored relatively easily. The device may be inflated either orally or mechanically, such as by blowing into a valve, or with a manual hand or foot-powered or electric pump.

Advantageously, the configuration and adjustability of the device allows patients to accomplish many different activities and also allows use by a larger segment of the population than those products currently available. The device may be configured, modified and positioned to accomplish certain exercises for strengthening of hips and knees, in preparation for gait activities, and for edema control at the lower extremities. The device may also be configured and modified to fit patients of various sizes, with various physiques. The optional removable spacers allow for accommodation of various limb sizes and limb conditions, including, but not limited to, amputee limbs. The device may be made in a variety of sizes (e.g., small, medium and large) to accommodate patients with various physiques.

Figure 8:
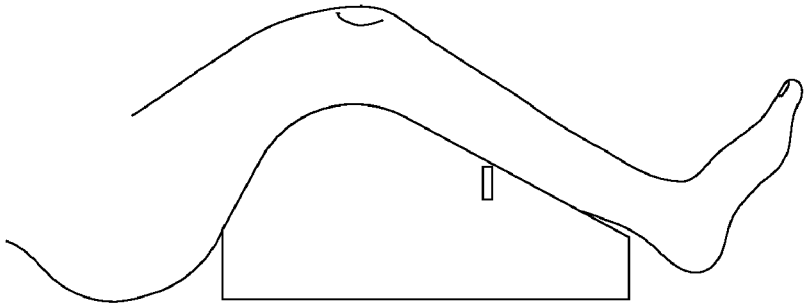
FIG. 8 is a side view of an exemplary lower extremity exerciser and positioning device in use for elevating a leg according to principles of the invention.

Illustratively, for lower leg exercise the superior support may be removed. To strengthen a patient's knee extensors, the patient may lie supine with a knee bent and resting on an inferior support. To perform the exercise the patient will extend his or her leg upwards, lifting his or her heel off the bed, and then return his or her legs back to a bent position with the heel returning to the bed, as shown in FIG. 8. The patient may repeat this exercise for any number of repetitions, and for each leg.

Figure 9:
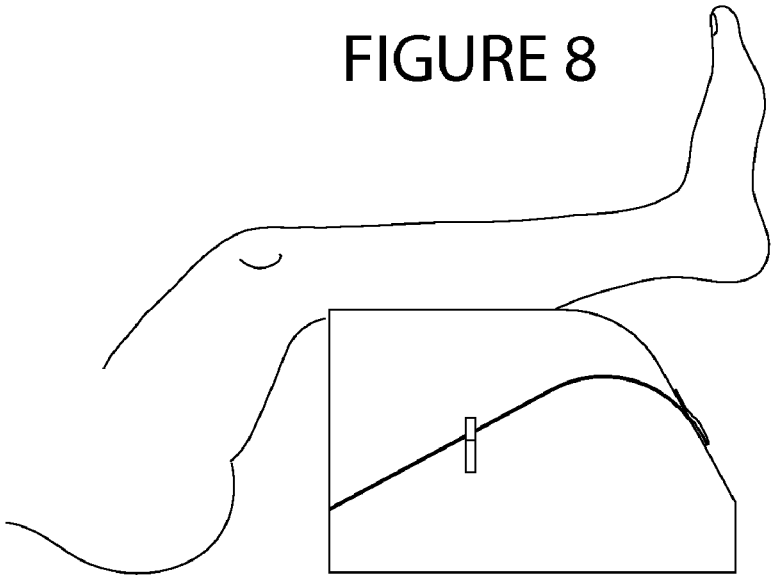
FIG. 9 is a side view of an exemplary lower extremity exerciser and positioning device in use for bending at the knee and elevating a heel according to principles of the invention.
Figure 10:
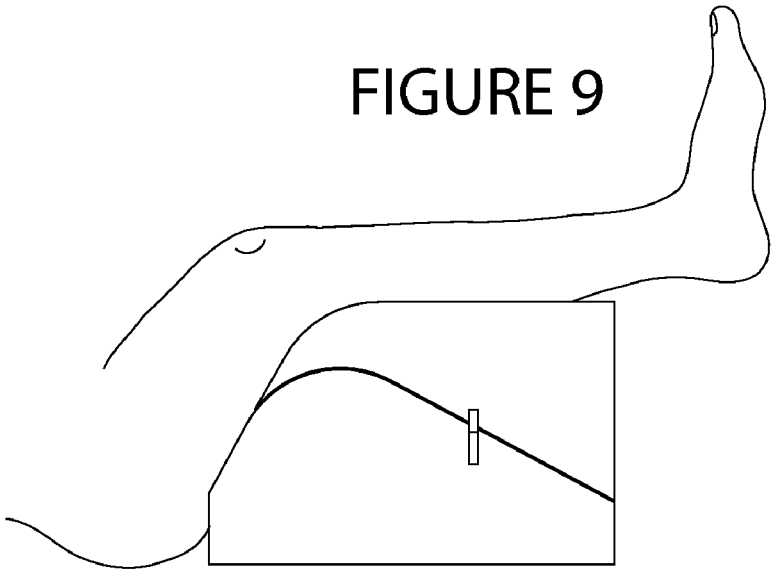
FIG. 10 is a side view of an exemplary lower extremity exerciser and positioning device in use for elevating a leg and allowing hip extension according to principles of the invention.

As another example, an exercise for strengthening hips entails placing the assembled device under the patient's thighs, as shown in FIGS. 9 and 10. To perform the exercise the patient will use his or her legs to apply pressure and raise his or her buttock off the bed, and then return his or her buttock back to the bed. The patient may repeat this exercise for any number of repetitions, and for each leg.

Some exercise regimens may require resistance. In such cases, to provide resistance during exercise, weights may be attached to a limb using a cuff (e.g., ankle weights on an ankle cuff). Alternatively, one or more elastic bands may be wrapped around or otherwise releasably attached to the limb(s) of a patient and either wrapped around or attached to the lower extremity exerciser and positioning device. Such elastic bands may comprise, for example, Thera-Band® elastic therapy bands or tubes by the Hygenic Corporation, headquartered in Akron, Ohio.

The device may also be used as a static support. The furrows allow for comfortable sacral and buttock pressure relief as well as heel pressure relief.

Figure 11:
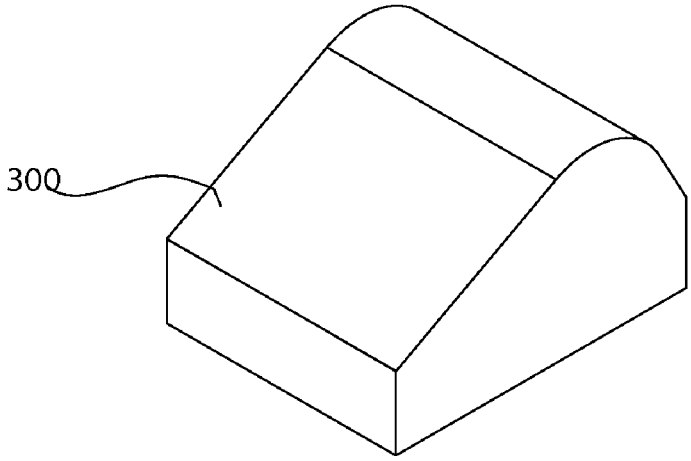
FIG. 11 is a first top perspective view of an alternative inferior support without a furrow for an exemplary lower extremity exerciser and positioning device according to principles of the invention.
Figure 12:
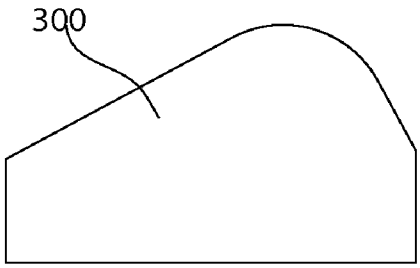
FIG. 12 is a side view of an alternative inferior support without a furrow for an exemplary lower extremity exerciser and positioning device according to principles of the invention.
Figure 13:
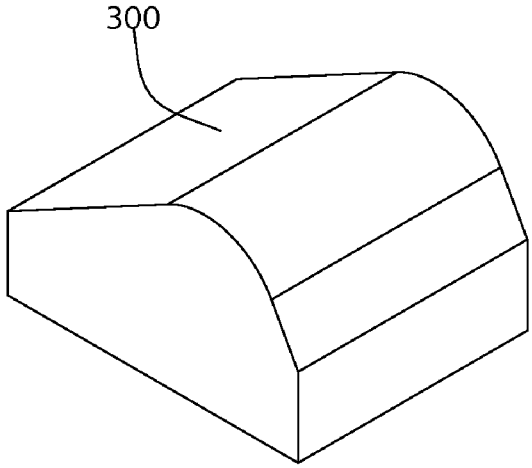
FIG. 13 is a second top perspective view of an alternative inferior support without a furrow for an exemplary lower extremity exerciser and positioning device according to principles of the invention.

In an alternative embodiment, as illustrated in FIGS. 11 through 13, the inferior support 300 may omit a furrow. In such an embodiment, the inferior support 300 may be used alone, or with a superior support 105, as described above.

Figure 14:
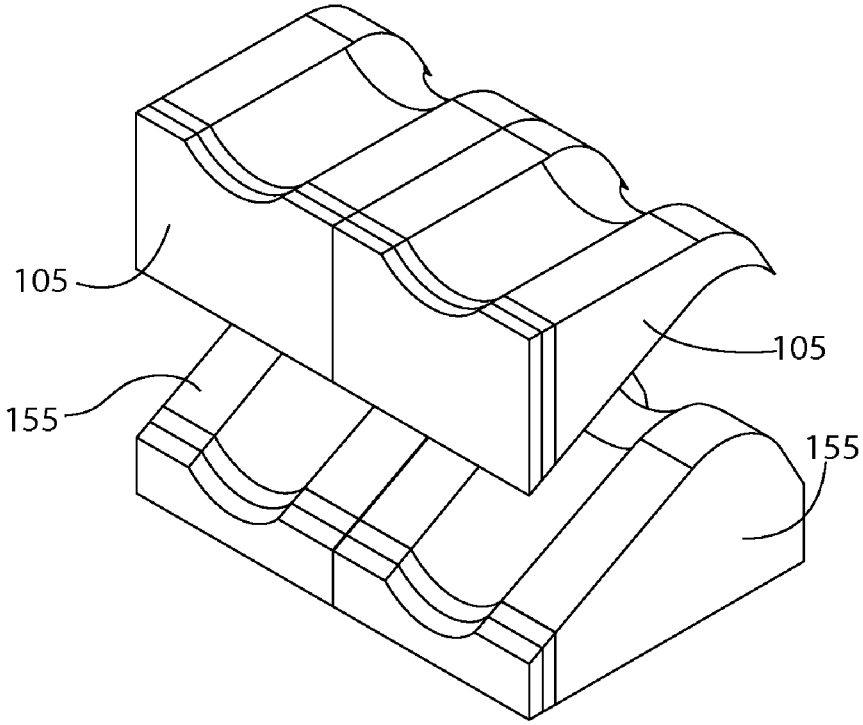
FIG. 14 is a top perspective exploded view of a side by side arrangement of an exemplary lower extremity exerciser and positioning devices according to principles of the invention.
Figure 15:
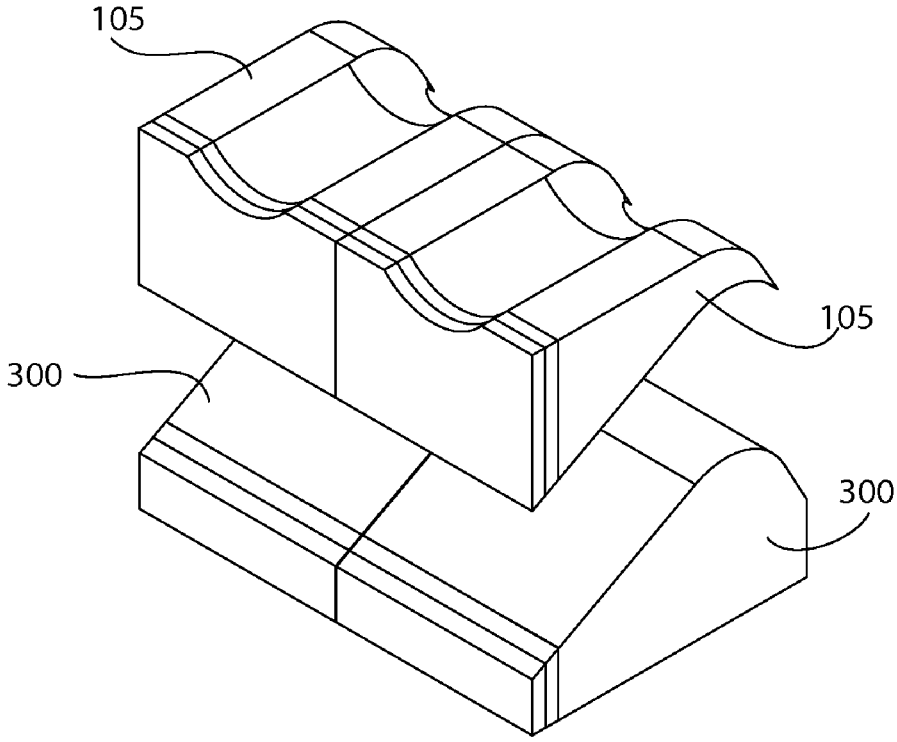
FIG. 15 is a top perspective exploded view of a side by side arrangement of exemplary lower extremity exerciser and positioning devices, including inferior supports without a furrow, according to principles of the invention.
Figure 16:
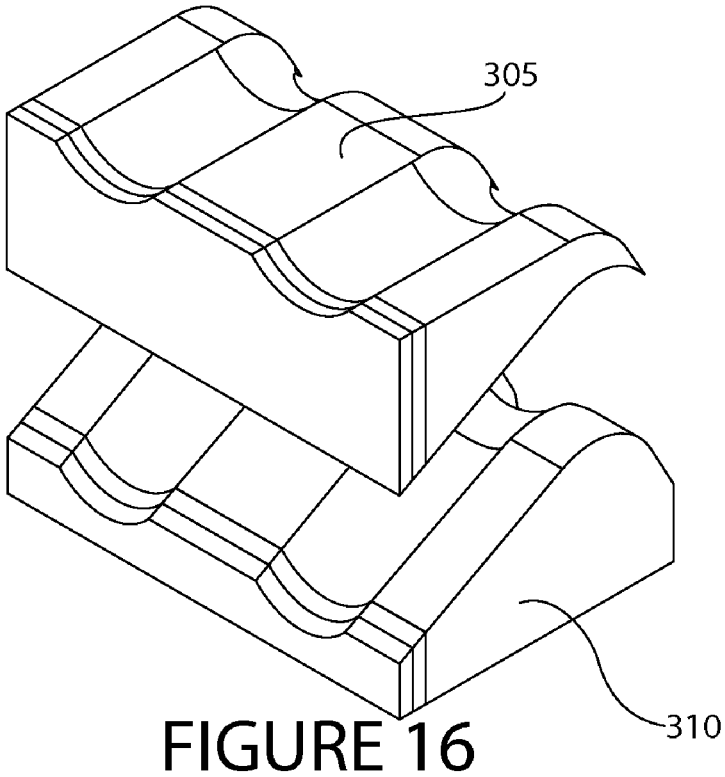
FIG. 16 is a top perspective exploded view of an integrated two-limb arrangement of an exemplary lower extremity exerciser and positioning devices according to principles of the invention.
Figure 17:
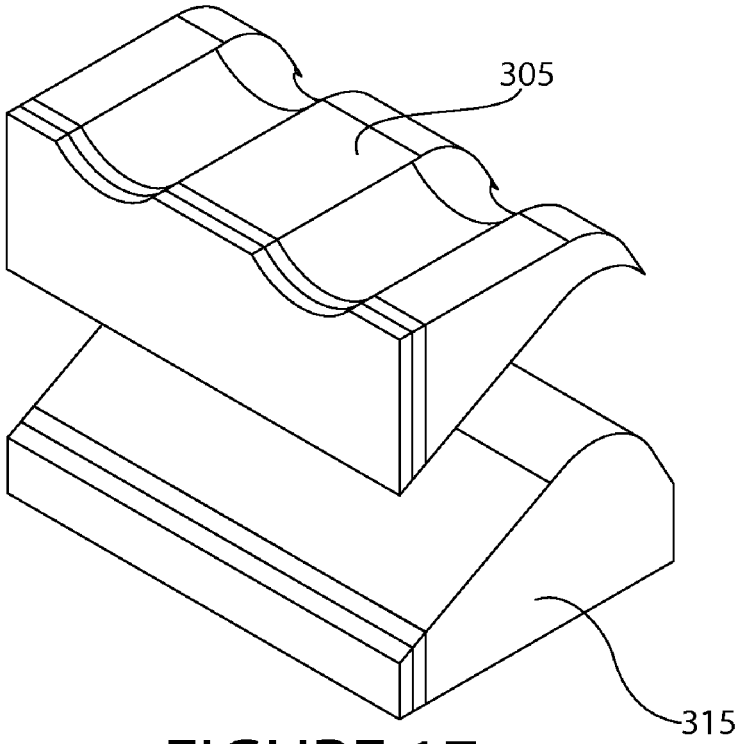
FIG. 17 is a top perspective exploded view of an integrated two-limb arrangement of exemplary lower extremity exerciser and positioning devices, including inferior supports without a furrow, according to principles of the invention.

An exemplary lower extremity exerciser and positioning device may be used on one limb at a time, as discussed above, or on two limbs simultaneously. Illustratively, a pair of lower extremity exerciser and positioning device may be used side-by-side, as shown in FIGS. 14 and 15, to support two limbs at a time. Alternatively, the lower extremity exerciser and positioning device may comprise a left limb assembly and right limb assembly formed in one integral unit. Thus, illustratively, the integral superior supports 305 and integral inferior supports 310, 315 of FIGS. 16 and 17, are each designed to accommodate two limbs (i.e., left and right limbs) simultaneously.

In yet another exemplary embodiment, the cushioning foam may contain one compartment (or more compartments) for an inflatable bladder, which can be inflated and deflated to increase or decrease the dimensions and/or amount of support provided. Each bladder may include a standard Schrader valve, surrounded by the foam. Thus, a bladder may be inflated using a standard bicycle style air pump.

Figure 18:
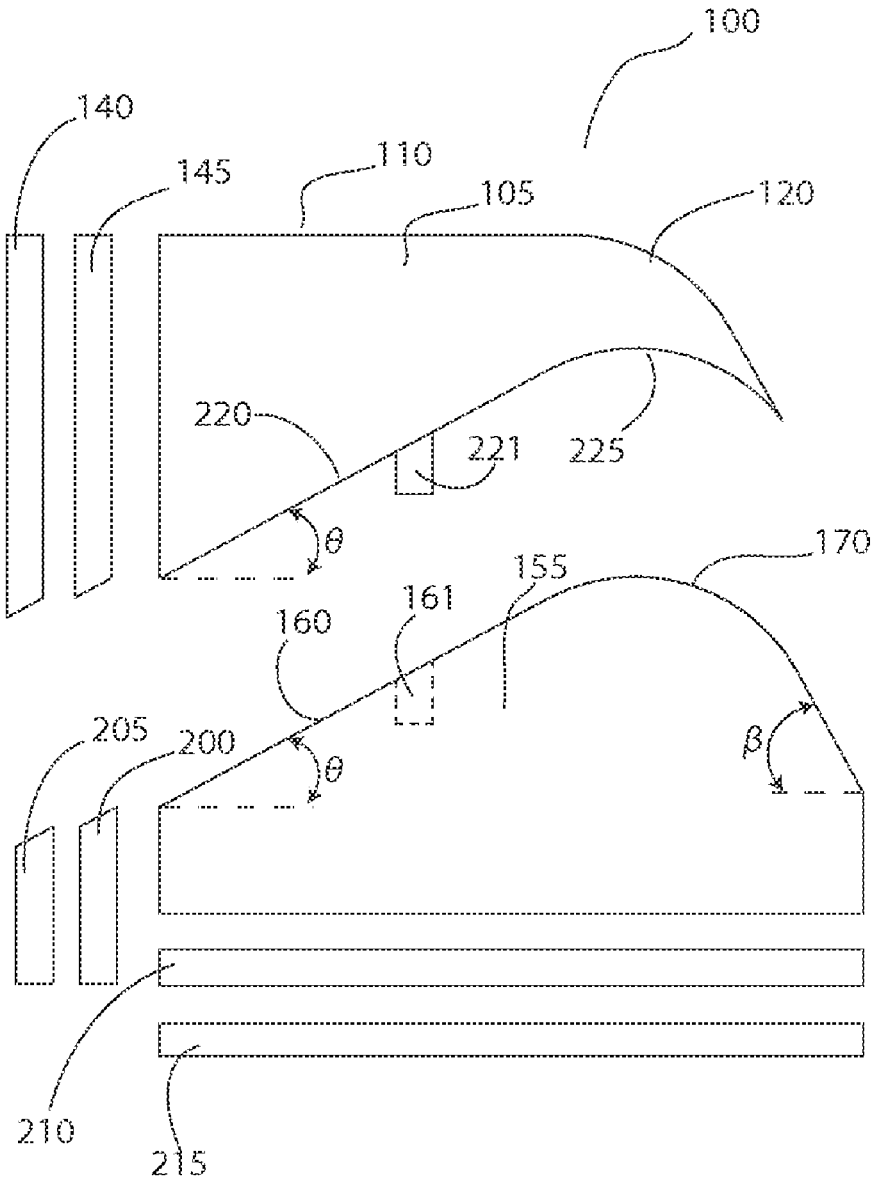
FIG. 18 is a profile view of an embodiment with a male protrusion extending from the bottom of the superior support and a corresponding female receptacle formed in the top surface of the inferior support, allowing interlocking mating of the inferior and superior supports without use of other attachments, such as hook and loop fasteners.

Referring now to FIG. 18, another embodiment with a male protrusion 221 extending from the bottom of the superior support 220 is shown. A corresponding female receptacle 161 is formed in the top surface of the inferior support 160. This configuration allows interlocking mating of the inferior and superior supports without use of other attachments, such as hook and loop fasteners. The male protrusion and corresponding female receptacle may be integrally formed parts of the device.

Figure 19:
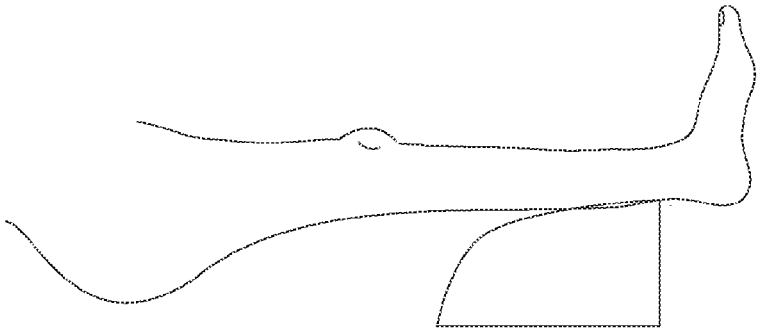
FIG. 19 is a profile view showing use of a device according to principles of the invention under the achilles tendon area or distal lower leg, for gravity assisted (passive) knee extension, for post-operative knee surgery patients, post-operative knee replacement surgery, anterior cruciate ligament repairs and patients with other lower leg therapy and rehabilitation needs.
Figure 20:
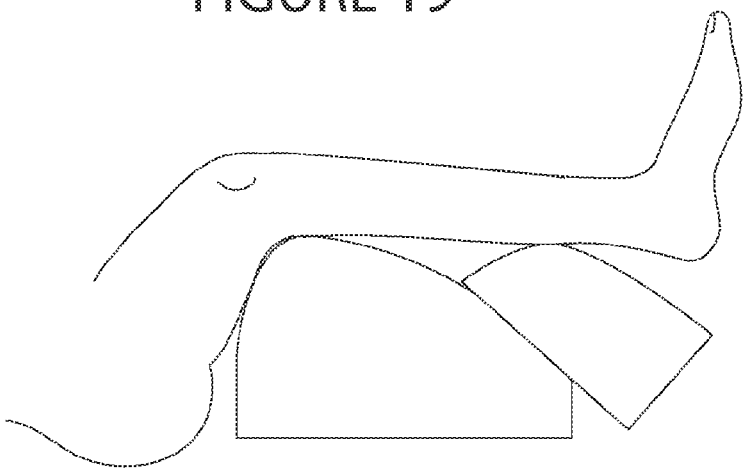
FIG. 20 is a profile view showing use of a device according to principles of the invention for relieving lower back discomfort or lower extremity edema, when a lower leg placement is more comfortable than the higher stacked position, where the hip and knee are almost 90°-90° "off placement position."
Figure 21:
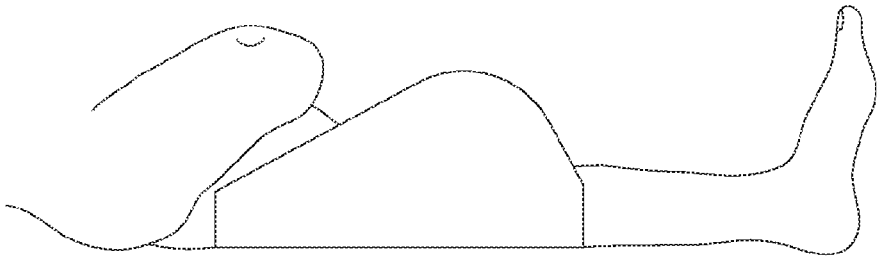
FIG. 21 is a profile view showing use of a device according to principles of the invention for amputee exercise.

Additional uses of the exemplary device are shown in FIGS. 19 through 21. FIG. 19 shows use under the achilles tendon area or distal lower leg, for gravity assisted (passive) knee extension, for post-operative knee surgery patients, post-operative knee replacement surgery, anterior cruciate ligament repairs and patients with other lower leg therapy and rehabilitation needs. FIG. 20 shows use for relieving lower back discomfort or lower extremity edema, when a lower leg placement is more comfortable than the higher stacked position, where the hip and knee are almost 90 deg.-90 deg. "off placement position." FIG. 21 shows use for amputee exercise.

While an exemplary embodiment of the invention has been described, it should be apparent that modifications and variations thereto are possible, all of which fall within the true spirit and scope of the invention. With respect to the above description then, it is to be realized that the optimum relationships for the components and steps of the invention, including variations in order, form, content, function and manner of operation, are deemed readily apparent and obvious to one skilled in the art, and all equivalent relationships to those illustrated in the drawings and described in the specification are intended to be encompassed by the present invention. The above description and drawings are illustrative of modifications that can be made without departing from the present invention, the scope of which is to be limited only by the following claims. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents are intended to fall within the scope of the invention as claimed.

What is claimed is:

1. A lower extremity exerciser and positioning device comprising a pair of wedge-shaped foam-core therapeutic supports configurable in a stacked arrangement, said pair of wedge-shaped foam-core therapeutic supports including an inferior support and a removable superior support, said inferior support having a planar inferior bottom surface, parallel planar inferior sides that are perpendicular to the inferior bottom surface, a planar inferior leading edge that is perpendicular to the inferior bottom surface and to the planar sides, a planar inferior trailing edge that is perpendicular to the inferior bottom surface and to the inferior sides, a sloped inferior planar top surface, and a curved inferior transitional surface coupling the sloped inferior planar top surface to the planar inferior trailing edge, said sloped inferior planar top surface extending from the planar inferior leading edge to the curved inferior transitional surface, a gradient of said sloped inferior planar top surface being positive from the planar inferior leading edge to the curved inferior transitional surface;

said superior support having a planar superior top surface, parallel planar superior sides that are perpendicular to the planar superior top surface, a planar superior leading edge that is perpendicular to the planar superior top surface and to the planar sides, a convex curved superior trailing edge, a sloped superior planar bottom surface, and a concave curved superior transitional surface coupling the sloped superior planar bottom surface to the curved superior trailing edge, said sloped superior planar bottom surface extending from the planar superior leading edge to the curved superior transitional surface, a gradient of said sloped superior planar bottom surface being positive from the planar inferior leading edge to the curved inferior transitional surface;

said superior support being stackable on the inferior support, the bottom surface of the superior support being configured to mate with the top surface of the inferior support, and the top surface of the superior support providing a surface for supporting a limb.

2. A lower extremity exerciser and positioning device according to claim 1, further comprising a male protrusion projecting from the bottom surface of the superior support and a corresponding female receptacle formed in the sloped inferior planar top surface, said female receptacle being configured to matingly receive the male protrusion when the superior support is positioned on top of the inferior support.

3. A lower extremity exerciser and positioning device according to claim 1, further comprising at least one length adjusting spacer releasably attachable to the planar inferior leading edge.

4. A lower extremity exerciser and positioning device according to claim 1, further comprising at least one length adjusting spacer releasably attachable to the planar inferior leading edge, and at least one height adjusting spacer releasably attachable to the planar inferior bottom surface.

5. A lower extremity exerciser and positioning device according to claim 1, further comprising at least one length adjusting spacer releasably attachable to the planar superior leading edge.

6. A lower extremity exerciser and positioning device according to claim 1, further comprising at least one inferior length adjusting spacer releasably attachable to the planar inferior leading edge, and at least one superior length adjusting spacer releasably attachable to the planar superior leading edge, said at least one superior length adjusting spacer being stackable on the at least one inferior length adjusting spacer.

7. A lower extremity exerciser and positioning device according to claim 1, further comprising at least one height adjusting spacer releasably attachable to the planar inferior bottom surface, at least one inferior length adjusting spacer releasably attachable to the planar inferior leading edge, and at least one superior length adjusting spacer releasably attachable to the planar superior leading edge, said at least one superior length adjusting spacer being stackable on the at least one inferior length adjusting spacer.

8. A lower extremity exerciser and positioning device according to claim 1, further comprising at least one inferior length adjusting spacer releasably attachable to the planar inferior leading edge, each of the at least one length adjusting inferior spacer having a sloped top inferior spacer surface with a gradient that is substantially the same as the gradient of said sloped inferior planar top surface.

9. A lower extremity exerciser and positioning device according to claim 1, further comprising at least one superior length adjusting spacer releasably attachable to the planar superior leading edge, each of the at least one length adjusting superior spacer having a sloped bottom superior spacer surface with a gradient that is substantially the same as the gradient of said sloped superior planar bottom surface.

10. A lower extremity exerciser and positioning device according to claim 1, further comprising an inferior concave furrow that extends across the sloped inferior planar top surface, the curved inferior transitional surface and the planar inferior trailing edge, said furrow providing an elongated, shallow, concave, depression for cradling an engaged portion of a limb.

11. A lower extremity exerciser and positioning device according to claim 1, further comprising a superior concave furrow that extends across the superior planar top surface and the convex curved superior trailing edge, said furrow providing an elongated, shallow, concave, depression for cradling an engaged portion of a limb.

12. A lower extremity exerciser and positioning device according to claim 1, further comprising an inferior concave furrow that extends across the sloped inferior planar top surface, the curved inferior transitional surface and the planar inferior trailing edge, said furrow providing an elongated, shallow, concave, depression for cradling an engaged portion of a limb; and a superior concave furrow that extends across the superior planar top surface and the convex curved superior trailing edge, said furrow providing an elongated, shallow, concave, depression for cradling an engaged portion of a limb.

13. A lower extremity exerciser and positioning device according to claim 1, further comprising an inferior concave furrow that extends across the sloped inferior planar top surface, the curved inferior transitional surface and the planar inferior trailing edge, said furrow providing an elongated, shallow, concave, depression for cradling an engaged portion of a limb; and a superior concave furrow that extends across the superior planar top surface and the convex curved superior trailing edge, said furrow providing an elongated, shallow, concave, depression for cradling an engaged portion of a limb;

the inferior concave furrow being in alignment with the superior concave furrow when the superior support is stacked on the inferior support.

14. A lower extremity exerciser and positioning device according to claim 1, further comprising an inferior concave furrow having a radius of curvature between about 2 and 5 inches, inferior concave furrow extending across the sloped inferior planar top surface, the curved inferior transitional surface and the planar inferior trailing edge, said inferior concave furrow providing an elongated, shallow, concave, depression for cradling an engaged portion of a limb; and a superior concave furrow having a radius of curvature between about 2 and 5 inches, superior concave furrow extending across the superior planar top surface and the convex curved superior trailing edge, said superior concave furrow providing an elongated, shallow, concave, depression for cradling an engaged portion of a limb;

the inferior concave furrow being in alignment with the superior concave furrow when the superior support is stacked on the inferior support.

15. A lower extremity exerciser and positioning device according to claim 1, the gradient of said sloped inferior planar top surface being between 15° and 60°.

16. A lower extremity exerciser and positioning device according to claim 1, the gradient of said sloped superior planar bottom surface being between 15° and 60°.

17. A lower extremity exerciser and positioning device according to claim 1, the gradient of said sloped inferior planar top surface being between 15° and 60°; and the gradient of said sloped superior planar bottom surface being between 15° and 60°.

18. A lower extremity exerciser and positioning device according to claim 1, further comprising an inferior concave furrow having a radius of curvature between about 2 and 5 inches, inferior concave furrow extending across the sloped inferior planar top surface, the curved inferior transitional surface and the planar inferior trailing edge, said inferior concave furrow providing an elongated, shallow, concave, depression for cradling an engaged portion of a limb; and a superior concave furrow having a radius of curvature between about 2 and 5 inches, superior concave furrow extending across the superior planar top surface and the convex curved superior trailing edge, said superior concave furrow providing an elongated, shallow, concave, depression for cradling an engaged portion of a limb;

the inferior concave furrow being in alignment with the superior concave furrow when the superior support is stacked on the inferior support;

at least one inferior length adjusting spacer releasably attachable to the planar inferior leading edge, each of the at least one length adjusting inferior spacer having a sloped top inferior spacer surface with a gradient that is substantially the same as the gradient of said sloped inferior planar top surface and a concave furrow in the sloped top inferior spacer surface, said concave furrow in the sloped top inferior spacer surface being in alignment with the inferior concave furrow when the inferior length adjusting spacer is releasably attached to the planar inferior leading edge; and at least one superior length adjusting spacer releasably attachable to the planar superior leading edge, each of the at least one length adjusting superior spacer having a sloped bottom superior spacer surface with a gradient that is substantially the same as the gradient of said sloped superior planar bottom surface.

19. A lower extremity exerciser and positioning device according to claim 1, further comprising an inferior concave furrow having a radius of curvature between about 2 and 5 inches, inferior concave furrow extending across the sloped inferior planar top surface, the curved inferior transitional surface and the planar inferior trailing edge, said inferior concave furrow providing an elongated, shallow, concave, depression for cradling an engaged portion of a limb; and a superior concave furrow having a radius of curvature between about 2 and 5 inches, superior concave furrow extending across the superior planar top surface and the convex curved superior trailing edge, said superior concave furrow providing an elongated, shallow, concave, depression for cradling an engaged portion of a limb;

the inferior concave furrow being in alignment with the superior concave furrow when the superior support is stacked on the inferior support;

at least one inferior length adjusting spacer releasably attachable to the planar inferior leading edge, each of the at least one length adjusting inferior spacer having a sloped top inferior spacer surface with a gradient that is substantially the same as the gradient of said sloped inferior planar top surface and a concave furrow in the sloped top inferior spacer surface, said concave furrow in the sloped top inferior spacer surface being in alignment with the inferior concave furrow when the inferior length adjusting spacer is releasably attached to the planar inferior leading edge; and at least one superior length adjusting spacer releasably attachable to the planar superior leading edge, each of the at least one length adjusting superior spacer having a sloped bottom superior spacer surface with a gradient that is substantially the same as the gradient of said sloped superior planar bottom surface, and a top superior spacer surface with a concave furrow, said concave furrow in the top superior spacer surface being in alignment with the superior concave furrow when the superior length adjusting spacer is releasably attached to the planar superior leading edge.

20. A lower extremity exerciser and positioning device according to claim 1, further comprising an inferior concave furrow having a radius of curvature between about 2 and 5 inches, inferior concave furrow extending across the sloped inferior planar top surface, the curved inferior transitional surface and the planar inferior trailing edge, said inferior concave furrow providing an elongated, shallow, concave, depression for cradling an engaged portion of a limb; and a superior concave furrow having a radius of curvature between about 2 and 5 inches, superior concave furrow extending across the superior planar top surface and the convex curved superior trailing edge, said superior concave furrow providing an elongated, shallow, concave, depression for cradling an engaged portion of a limb;

the inferior concave furrow being in alignment with the superior concave furrow when the superior support is stacked on the inferior support;

at least one inferior length adjusting spacer releasably attachable to the planar inferior leading edge, each of the at least one length adjusting inferior spacer having a sloped top inferior spacer surface with a gradient that is substantially the same as the gradient of said sloped inferior planar top surface and a concave furrow in the sloped top inferior spacer surface, said concave furrow in the sloped top inferior spacer surface being in alignment with the inferior concave furrow when the inferior length adjusting spacer is releasably attached to the planar inferior leading edge; and at least one superior length adjusting spacer releasably attachable to the planar superior leading edge, each of the at least one length adjusting superior spacer having a sloped bottom superior spacer surface with a gradient that is substantially the same as the gradient of said sloped superior planar bottom surface, and a top superior spacer surface with a concave furrow, said concave furrow in the top superior spacer surface being in alignment with the superior concave furrow when the superior length adjusting spacer is releasably attached to the planar superior leading edge; and a plurality of hook and loop fasteners configured for attaching the inferior support to the removable superior support, and the at least one superior length adjusting spacer to the planar superior leading edge, and the at least one inferior length adjusting spacer to the planar inferior leading edge.

* * * * *